US005868080A

United States Patent [19]

Wyler et al.

[11] Patent Number: 5,868,080

[45] Date of Patent: Feb. 9, 1999

[54] REINFORCED PLASTIC PALLETS AND METHODS OF FABRICATION

[75] Inventors: Craig Steven Wyler, Cambridge; Daniel Darst, Wyoming; Russell Leroy Moseman, Hinckley, all of Minn.

[73] Assignee: Engineered Polymers Corp., Mora, Minn.

[21] Appl. No.: 751,401

[22] Filed: Nov. 18, 1996

[51] Int. Cl.[6] ..... B65D 19/00

[52] U.S. Cl. ..... 108/57.25; 108/901

[58] Field of Search ..... 108/57.25, 57.26, 108/57.27, 57.28, 901, 902, 51.11, 56.1

[56] References Cited

U.S. PATENT DOCUMENTS

| | | | |
|---|---|---|---|
| 3,664,271 | 5/1972 | Wolder et al. . | |
| 3,680,496 | 8/1972 | Westlake, Jr. . | |
| 3,710,733 | 1/1973 | Story | 108/57.28 |
| 3,880,092 | 4/1975 | Seeber et al. | 108/57.28 |
| 4,051,787 | 10/1977 | Nishitani et al. . | |
| 4,103,857 | 8/1978 | Levenhagen | 108/57.28 X |
| 4,133,270 | 1/1979 | Ravera . | |
| 4,403,555 | 9/1983 | Forrest . | |
| 4,597,338 | 7/1986 | Kreeger . | |
| 4,735,154 | 4/1988 | Hemery | 108/56.1 |
| 4,799,433 | 1/1989 | Luft . | |
| 4,843,976 | 7/1989 | Pigott et al. . | |
| 4,869,179 | 9/1989 | Sammons et al. | 108/56.1 |
| 5,042,397 | 8/1991 | Fielder . | |
| 5,090,336 | 2/1992 | Longaker, Sr. et al. . | |
| 5,105,746 | 4/1992 | Reynolds | 108/56.1 |
| 5,255,613 | 10/1993 | Shuert | 108/901 X |
| 5,298,098 | 3/1994 | Hoedl . | |
| 5,343,814 | 9/1994 | Pigott et al. . | |
| 5,391,251 | 2/1995 | Shuert . | |
| 5,404,829 | 4/1995 | Shuert . | |
| 5,417,167 | 5/1995 | Sadr | 108/901 X |
| 5,456,189 | 10/1995 | Belle Isle . | |
| 5,497,709 | 3/1996 | Gonzalez et al. . | |
| 5,505,141 | 4/1996 | Barber . | |

FOREIGN PATENT DOCUMENTS

| | | |
|---|---|---|
| 27 33 456 | 7/1977 | Germany . |
| 2-219746 | 9/1990 | Japan . |
| 5-338653 | 12/1993 | Japan . |

OTHER PUBLICATIONS

"Introduction to Pultrusion," Creative PUItrusions, Inc. Design Guide, pp. 1.1—1.6 (Oct., 1990).

Morrison Molded Fiberglass Company product Literature "Dura Grid Customer Fiberglass Grids and Grating" pp. 1–7,9 (Aug. 1995).

*Primary Examiner*—Jose V. Chen

*Attorney, Agent, or Firm*—Mintz, Levin, Cohn, Ferris, Glovsky and Popeo, P.C.

[57] ABSTRACT

A reinforced plastic pallet construction and assembly method are presented wherein multiple reinforcing bars are employed, at least some of the reinforcing bars having an exposed surface at a top surface, underneath surface or bottom surface of the pallet. In addition to functioning as a reinforcing member, the exposed surfaces of the reinforcing bars comprise an anti-skid surface for maintaining positioning of payload on the pallet or facilitating transport of the pallet, e.g., via a forklift or automated transport system. Various techniques for retaining the reinforcing bars within channels formed in the plastic pallet body are described. The reinforcing bars preferably comprise composite structural members of fiberglass reinforced plastic fabricated from a pultrusion process.

11 Claims, 11 Drawing Sheets

SCENARIO 1

SCENARIO 2

SCENARIO 3

SCENARIO 1

SCENARIO 2

SCENARIO 3

REINFORCED PLASTIC PALLETS AND METHODS OF FABRICATION

TECHNICAL FIELD

The present invention relates in general to pallets for storing and transporting goods, and more particularly, to a reinforced plastic pallet and fabrication method wherein reinforcing members comprising composite structural members of fiberglass reinforced plastic are employed in various configurations.

BACKGROUND ART

As is well known, pallets are customarily used to transport and store goods. Palletized goods are typically maintained in position above a floor for handling by forklift equipment, i.e., through the insertion of forklift tines into special channels in the pallet or through engagement with the undersurface of the top deck of the pallet.

Pallets have traditionally been formed of wood. Wood pallets, however, have many disadvantages. For example, they are subject to breakage and are therefore reusable only over a short period of time. Wooden pallets are also difficult to maintain in a sanitary condition, thereby limiting their usability in applications where sanitation is important, such as in food handling applications.

In the past decades, with the growth of the plastics industry a wide variety of plastics have been investigated to determine their suitability for use in producing pallets. Plastic pallets can easily be molded and are stronger and lighter weight than wooden pallets. They can also now be made with recyclable materials. Furthermore, plastic pallets are more durable than wooden pallets. Plastic pallets have only been employed to some degree of success, however. Although plastic pallets heretofore have been generally durable, have been reusable over an extended period of time and have been easy to maintain in a sanitary condition, they have suffered from the disadvantage of cost. Although manufacturing costs are reflected in the cost of the plastic pallets, a principal reason that plastic pallets cost considerably more than comparable wooden pallets is that they require a given amount of relatively expensive plastic material for a desired measure of pallet strength.

Another significant issue with plastic pallets is the tendency of payload to slip on the pallet and of the pallet to move either relative to forklift tines or a transport surface. Obviously, if payload slips on a plastic pallet or the pallet tends to slide relative to forklift tines, or move on a transport surface, its commercial acceptability will be limited.

Thus, there remains a need in the art for a plastic pallet structure with improved strength to weight ratio, reduced cost and an anti-slip design. The structures presented herein are directed to this need.

DISCLOSURE OF INVENTION

Briefly summarized, the invention comprises in one aspect a reinforced plastic pallet having a molded plastic pallet body with at least one channel formed in an upper surface thereof. At least one reinforcing bar is provided sized to reside within the channel formed in the upper surface of the molded plastic pallet body such that the reinforcing bar has an exposed surface at the upper surface of the molded plastic pallet body. Preferably, the exposed surface of the reinforcing bar comprises an anti-skid surface to inhibit movement of payload disposed on the reinforced plastic pallet. The reinforcing bar may comprise a composite structural member of fiberglass reinforced plastic fabricated from a pultrusion process.

In another aspect, the invention comprises a reinforced plastic pallet having a molded plastic body with at least one channel formed in a lower surface thereof and at least one reinforcing bar sized to reside within the at least one channel. The reinforcing bar has an exposed surface at the lower surface of the molded plastic pallet body when the bar is positioned within the at least one channel. Preferably, the exposed surface of the at least one reinforcing bar comprises an anti-skid surface for engagement with a forklift tine and/or pallet jack interface.

In still another aspect, the present invention comprises a reinforced plastic pallet comprising a molded plastic pallet body having multiple channels formed therein, and multiple reinforcing bars positioned within the multiple channels. The reinforcing bars comprise composite structural members of fiberglass reinforced plastic fabricated from a pultrusion process.

In a further aspect, a reinforced plastic pallet is provided wherein a molded plastic top deck and a molded plastic bottom deck are secured together. The molded plastic bottom deck has at least one channel formed in a lower surface thereof. At least one reinforcing bar is sized to reside within the at least one channel formed in the lower surface of the bottom deck such that the reinforcing bar has an exposed surface at the lower surface of the bottom deck. Preferably, the exposed surface comprises an anti-skid surface for ensuring non-slip contact with a floor or racking structure.

Numerous enhancements to the various aspects of the present invention outlined above are described and claimed herein. In addition, certain methods of assembly are presented and claimed.

Provided herein are various implementations of an improved reinforced plastic pallet and method of assembly. The plastic pallet includes multiple reinforcing bars, preferably fabricated of fiberglass reinforced plastic produced from a pultrusion or molding process. Advantageously, a surface of each reinforcing bar can remain exposed above an upper surface of a single or dual deck pallet design to provide an anti-skid surface for payload disposed on the pallet. Reinforcing bars could also or alternatively be disposed to provide an exposed surface on the underside of the payload surface, again to establish an anti-skid surface in combination with providing structural support for the pallet. This anti-skid surface would be engaged by forklift tines and/or a pallet jack interface/handling mechanism to prevent slippage of the pallet when being moved. Reinforcing bars can also be disposed at a lower surface of a runner structure or lower deck so that an exposed anti-skid surface is provided to contact a floor or racking structure, for example, to facilitate use of the pallet with automated warehouse handling equipment.

In all embodiments, the use of fiberglass reinforced plastic support members provides increased strength and load-carrying capability, as well as overall pallet integrity, while at the same time reducing weight of the pallet in comparison with prior reinforced plastic pallets. The particular reinforcing described herein is corrosion resistant, is compatible with thermal expansion rates with plastic resins and takes a low set flexural modulus. Numerous additional advantages to the structures and methods set forth herein will be apparent to one of ordinary skill in the art in view of the embodiments presented below.

BRIEF DESCRIPTION OF THE DRAWINGS

These and other features, aspects and advantages of the present invention will be more fully understood from the following detailed description of certain preferred embodiments when read in conjunction with the accompanying drawings in which.

In the drawings like reference numbers designate like parts in the various views.

BEST MODE FOR CARRYING OUT THE INVENTION

Figure 1:
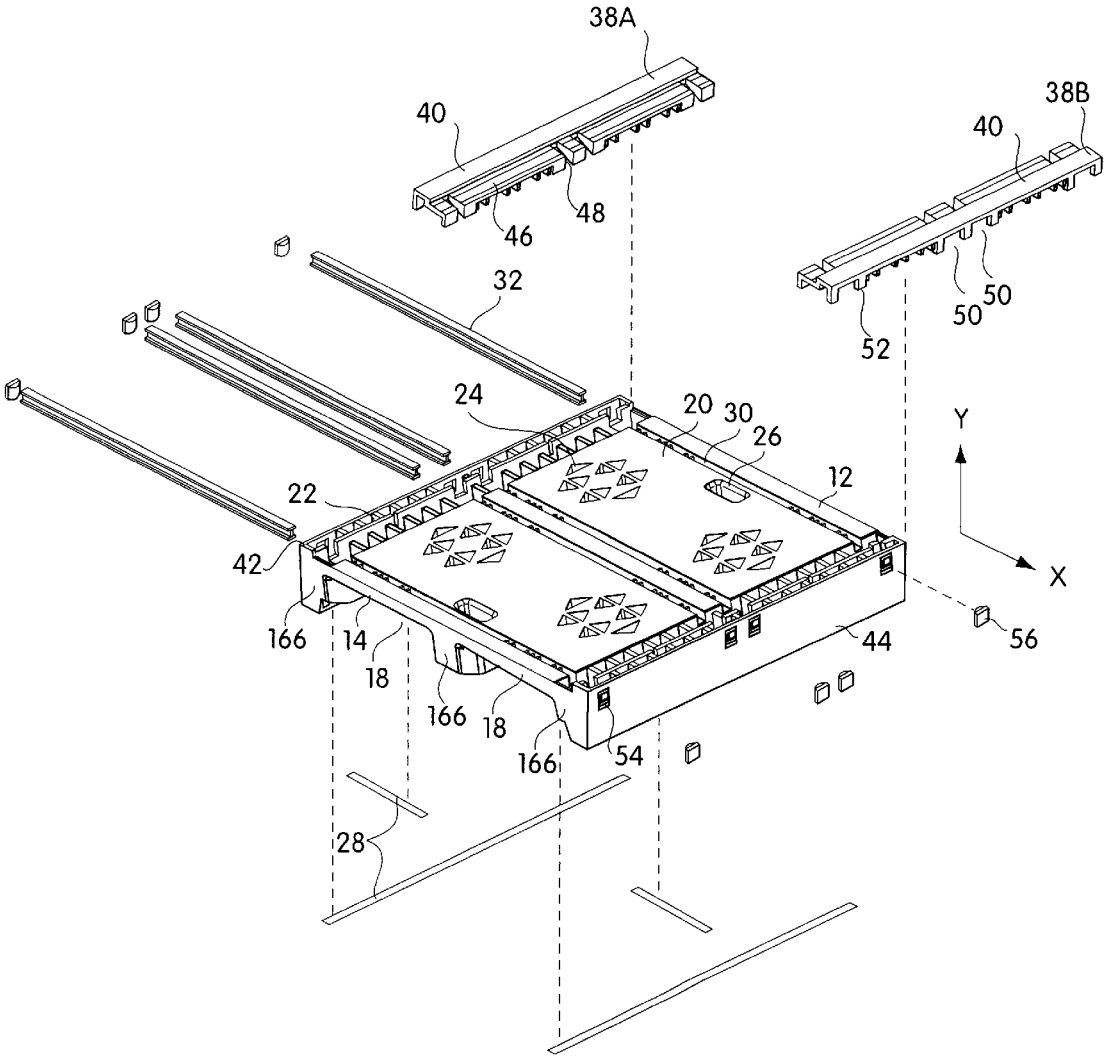
FIG. 1 is an exploded perspective view of a first embodiment of the reinforced plastic pallet of the present invention.

FIG. 1 presents an exploded view of a first embodiment of a reinforced plastic pallet 10 constructed in accordance with the principles of the present invention. Pallet 10 includes a generally rectangular-shaped molded plastic pallet body 12 with a single top deck 14 supported by three runners or leg structures 16*a*, 16*b*, and 16*c*. In this example, the runners extend parallel to a short or Y axis and define parallel recesses 18 on the underside of pallet 12 for receiving, for example, forklift tines to facilitate pallet handling.

Deck 14 may be provided with various patterns of supporting ribs 22, drainage holes 24 and/or hand holds 26, as is well known in the art. Pallet body 12 preferably comprises a unitary structure molded from recycled and/or virgin commodity plastic, e.g. high density polyethylene using a structural foam or injection molding process or other known forming process. Bottom side anti-skid strips 28, of known construction, can be adhered or otherwise secured along the lengths of runners 16*a* and 16*c* and across recesses 18, as shown in order to reduce skidding of pallet 10 on a supporting surface and/or forklift tines.

Figure 2:
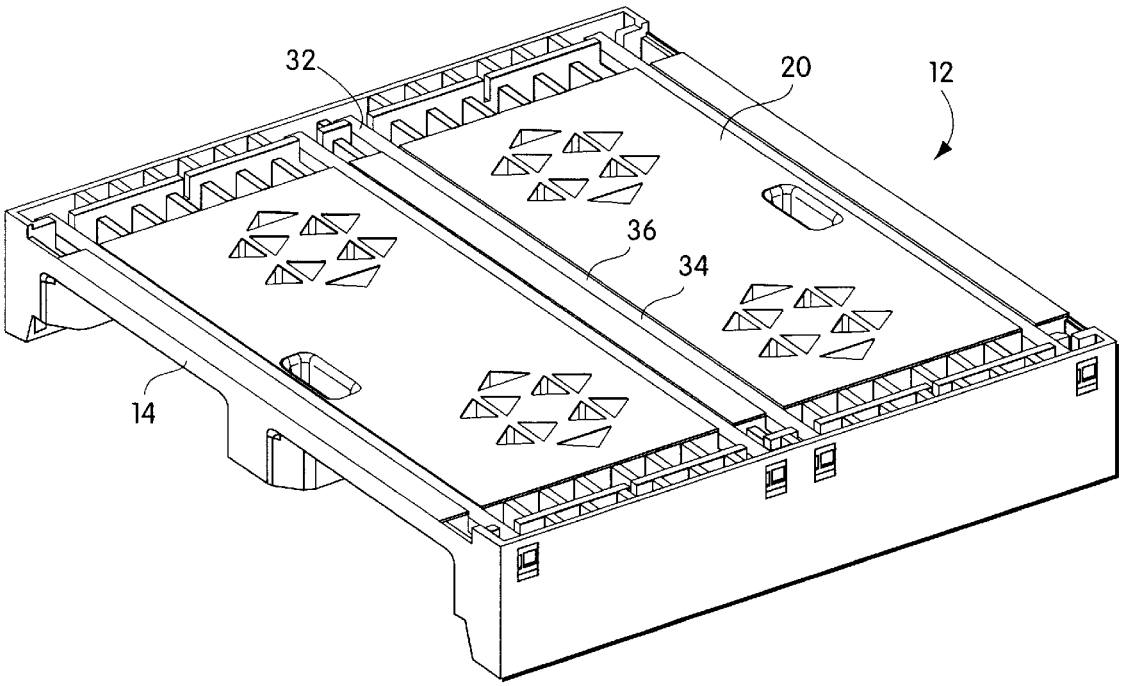
FIG. 2 is a perspective view of the pallet body of FIG. 1 with in-place reinforcing bars.
Figure 3:
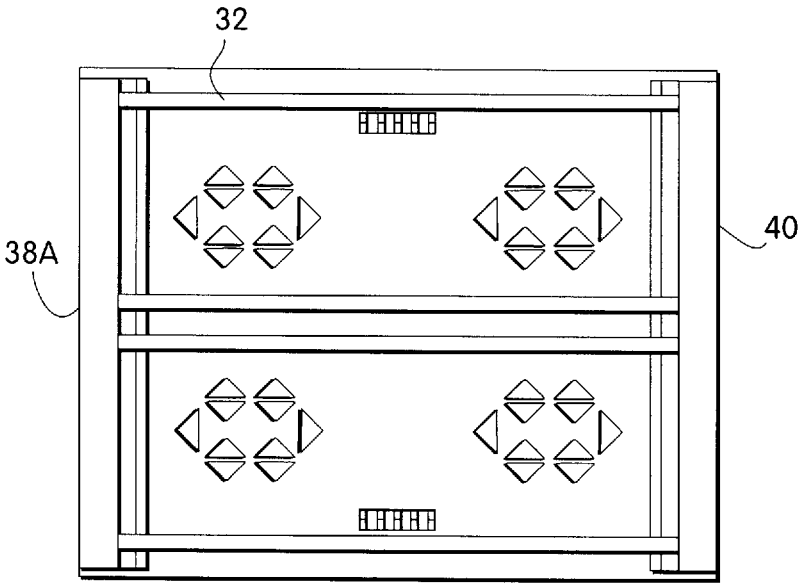
FIG. 3 is a top-plan view of the assembled pallet of FIG. 1.
Figure 4:
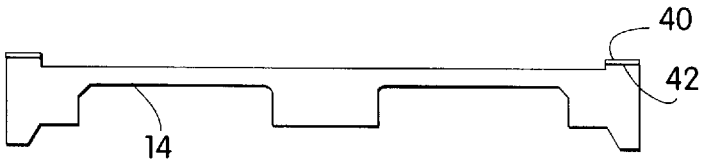
FIG. 4 is a front-elevational view of the pallet shown in FIG. 3.

In accordance with the principles of the present invention, the upper surface 20 of deck 14 is provided with multiple parallel channels 30 extending along the long or X-axis. Channels 30 are formed as part of the molding process and are configured to receive and support corresponding reinforcing bars 32. Reinforcing bars 32 comprise elongated structural members made of composite material. As illustrated in the partially assembled perspective view of FIG. 2 and the fully assembled top plan view of FIG. 3, reinforcing bars 32 have an exposed generally planar top surface 34 which is substantially parallel to and, preferably, coplanar or slightly elevated with respect to upper surface 20 of deck 14. Reinforcing bars 32 may have an I-shaped cross section, as shown in FIG. 2. Bars having alternative cross-sectional shapes such as rectangular, square, H, T or other custom profiles may also be used, depending upon the intended application and allowing flexibility in the design of the reinforced pallet. The exposed surface 34 of each reinforcing bar 32 preferably comprises an integral anti-skid surface 36, formed e.g. by knurling or roughening, and/or with anti-skid material. The anti-skid surface 36 serves to limit payload movement on the upper surface 20 of pallet 10.

Reinforcing bars 32 are made of composite material such as fiberglass reinforced plastic fabricated from a pultrusion process. The pultrusion process is well known and described, for example, in (1) "Introduction to Pultrusion" Creative PULtrusions, Inc. Design Guide, pp. 1.1–1.6, October 1990, and (2) Morrison Molded Fiberglass Company product literature "Dura Grid Customer Fiberglass Grids and Gratings", pp. 1–7, 9, August 1995, both of which documents are incorporated by reference herein. Preferably, the composite is made up of straight strands of glass fibers that are wrapped by a glass sleeving and combined with epoxy resin during the pultrusion process. The anti-skid material is preferably a combination of silicon oxide and epoxy resin which can be applied to one or more surfaces of the composite structure in varying amounts depending upon the desired application. In the pultrusion process, the base material is pulled through a liquid resin bath and then into a heated shaping die where the resin is thermoset, producing a continuous solid part in the shape of the cavity of the die. The pultrusion process is commercially well established and reinforcing bars 32 can be manufactured using this process from a wide variety of high performance thermosetting resins and reinforcements. The resulting composite reinforcing bars provide significant advantages over earlier incorporated steel, aluminum or wood structural members in terms of improved strength to weight ratio, corrosion resistance, compatible thermo-expansion rates, and a low flexural modulus which allows the bars of the present invention to flex back to position rather than become permanently deformed with excess weight. In addition to providing significantly higher load ratings in plastic pallets, the composite reinforcing bars of the present invention simultaneously add anti-skid properties, e.g., to secure a load on the upper surface of the pallet or, as more fully described hereinafter, to ensure an anti-skid interface between a lower surface of the pallet and forklift tines during handling or transport.

Referring again to FIG. 1, reinforcing bars 32 are secured within channels 30 with first and second molded side positioning members 38*a*, 38*b*. These side positioning members are configured to mate with and reside partially above the respective sides of deck 14. Each side positioning member 38 has a raised surface 40 which cooperates with a raised ledge 42 at the side walls 44 at the sides of deck 14. Dependent from raised surface 40 is a lower surface 46 which when side positioning members 38 are assembled to pallet body 12, lie in substantially the same plane as upper surface 20 of deck 14. Notches 48 are cut out of surface 46 to accommodate the exposed anti-skid surface 36 of reinforcing bars 32. Depending from the other side of raised surface 40 of side positioning members 38 are a series of retainer members 50. Retainer members 50 have a through aperture 52 designed to overlie and align with corresponding openings 54 in side walls 44 of pallet body 12. Openings 54 are preferably aligned with channels 30 in the top surface 20 of deck 14. These side wall openings allow for insertion of reinforcing bars 32 into channels 30 of pallet body 12. Once reinforcing bars 32 are correctly positioned within corresponding channels 30 (as shown in FIG. 2), side positioning members 38 are mounted on the sides of pallet body 12. Self-locking snap clips 56 are then inserted through aligned retainer apertures 52 and side wall openings 54 to thereby lock the side positioning members 38 to pallet body 12 and simultaneously secure the multiple reinforcing bars 32 in their respective channels 30.

Figure 5:
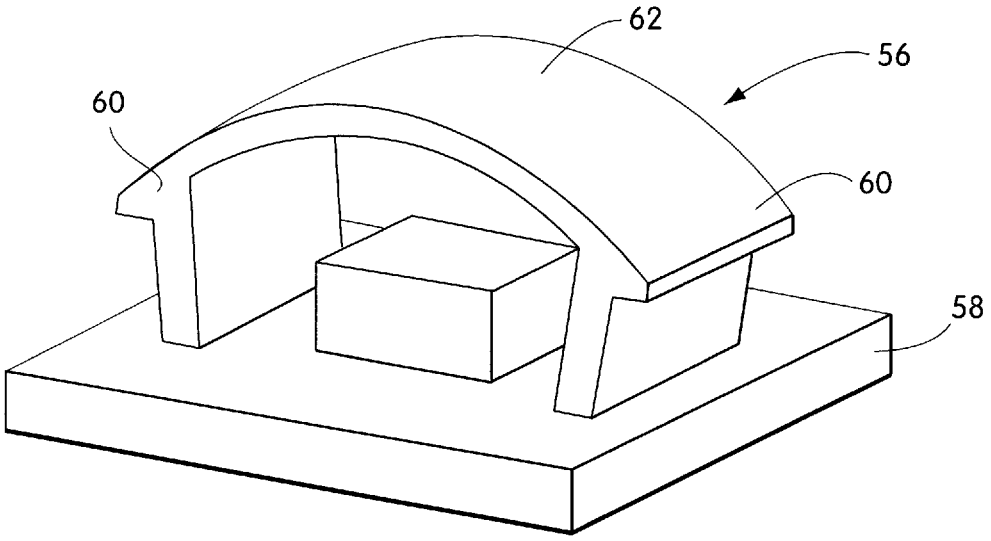
FIG. 5 is a perspective view of a snap clip used in assembling the pallet of FIG. 1.

A preferred self-locking snap clip 56 is illustrated in FIG. 5. Clip 56 includes a base member 58 supporting two cantilever snaps 60 bridged by a flexible member 62. When collapsed, flexible member 62 provides tension to self-lock the clip 56 against the inner surface of side walls 44. Clips of other design, or other retaining means may be employed to secure side positioning members 38 to the sides of pallet body 12.

Figure 6:
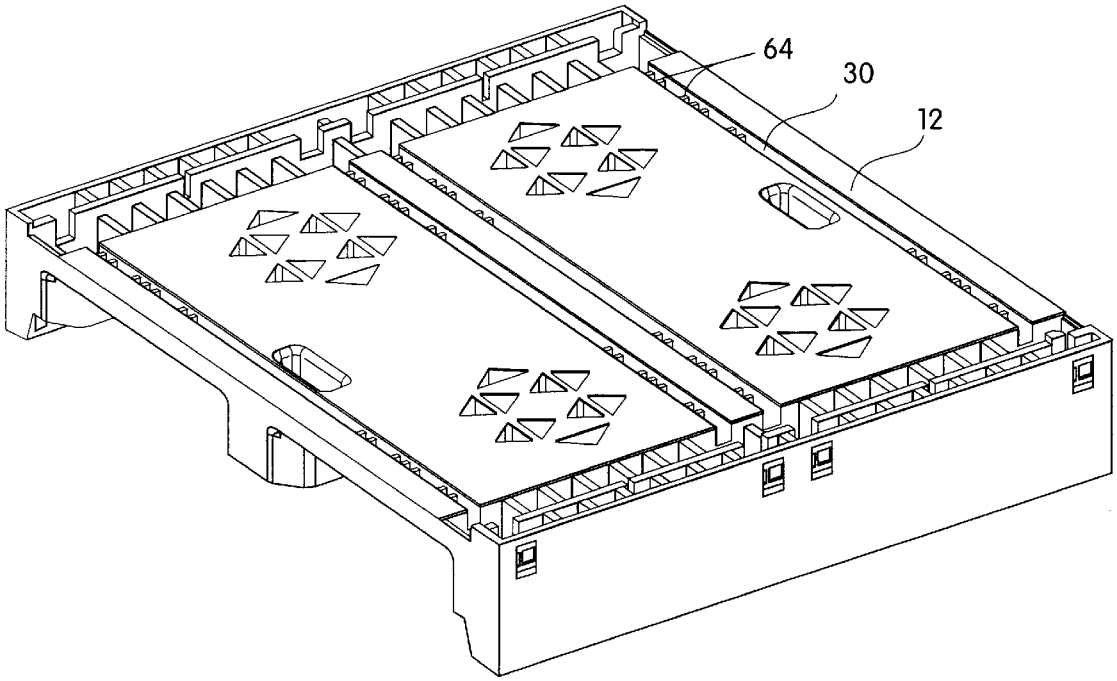
FIG. 6 is a perspective view of a pallet body employing multiple channel fins for retaining reinforcing bars.

FIG. 6 depicts a modified version of pallet body 12 in which appropriately shaped fins 64 are provided along one or both side walls of channels 30 to engage side walls of reinforcing bars 32 to help secure the bars within channels 30. Fins 64 are preferably molded along with the rest of pallet body 12. The number, shape, and location of such fins can vary from that shown in FIG. 6. Also, depending upon the implementation, fins 64 may be the only means for securing the reinforcing bars within the channels.

The composite reinforcing bars of the present invention which provide not only increased integrity and strength to the plastic pallet but also enhanced anti-skid properties can be mounted in various locations in the pallet body depending upon the desired application. FIGS. 7A–7F illustrate three different scenarios for single deck and dual deck pallets. When it is desired to limit movement of a load on top of the pallet (Scenario 1), reinforcing bars 32 can advantageously be mounted in upper surface 20 of top deck 14 of either a single deck (FIG. 7A) or dual deck (FIG. 7D) pallet. To limit movement of the pallet upon forklift tines or at a pallet jack interface (Scenario 2), reinforcing bars 32 can be mounted in pallet body 16 so that the anti-skid surface of the bars is exposed at a lower surface 66 of top deck 14, in either a single deck (FIG. 7B) or a dual deck (FIG. 7E) pallet. To reduce movement of the pallet on a floor surface (Scenario 3), e.g. a metal floor of a moving vehicle, reinforcing bars 32 can be mounted at the lower surface of runners 16 in a single deck pallet (FIG. 7C) or the lower surface of a bottom deck 68 of a dual deck pallet (FIG. 7F) so that the anti-skid surface of the bars 32 rest on the floor surface. Such reinforcing bars with their exposed anti-skid surfaces can also be concurrently applied to multiple surfaces of the pallet, i.e. upper surface 20 of top deck 14, lower surface 66 of top deck 14, and/or lower surface 70 of runner 16 or bottom deck 68.

Figure 7A:
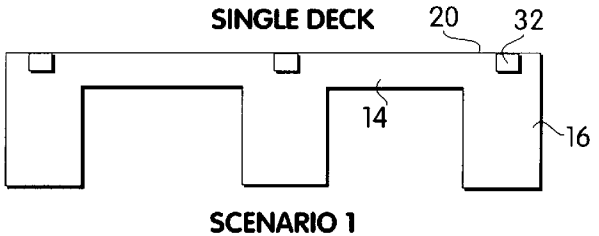
FIGS. 7A–7F are schematic illustrations depicting various possible locations of the reinforcing bars of the present invention in single deck and dual deck pallets.
Figure 7B:
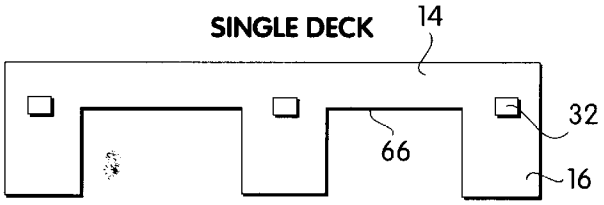
Figure 8B:
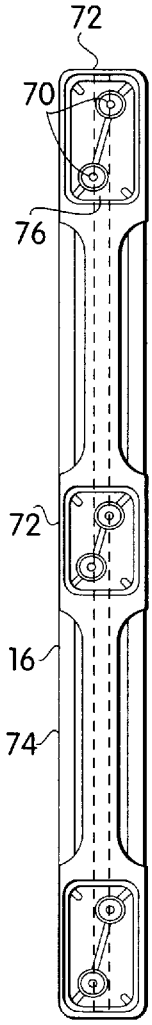
FIG. 8B is a top plan view of a runner structure used with the single deck pallet of FIG. 8A.
Figure 8A:
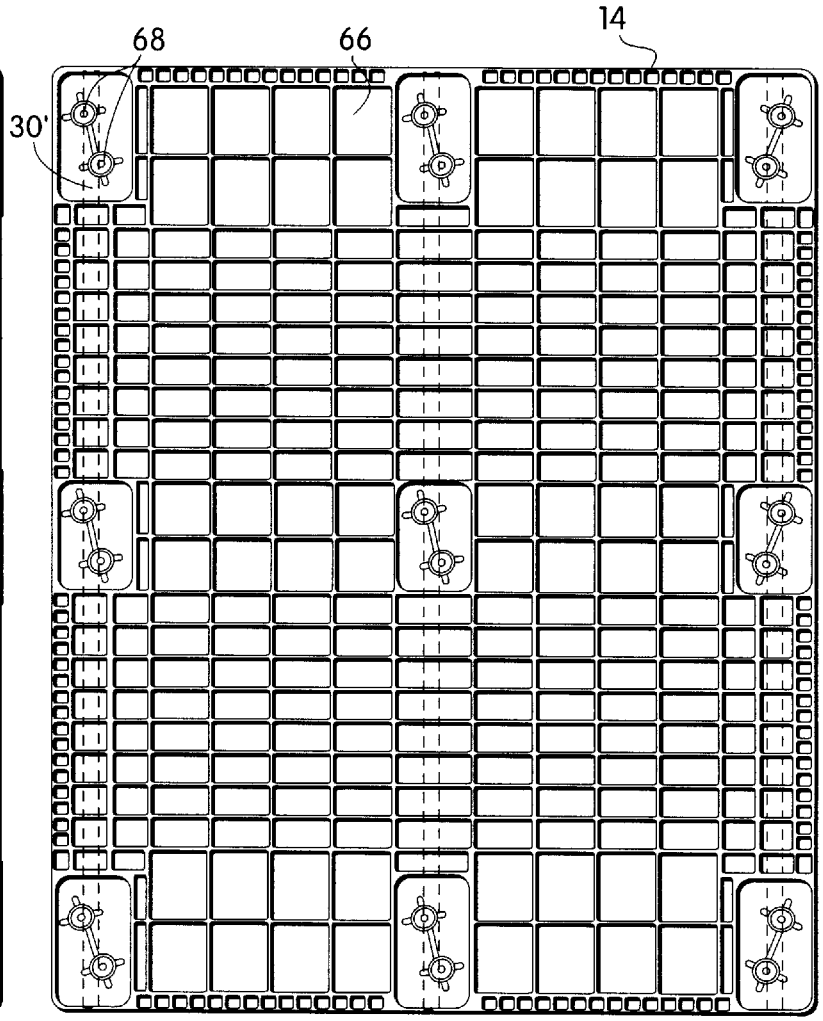
FIG. 8A is a plan view of the lower surface of a deck of a single deck pallet accommodating multiple parallel reinforcing bars.

One implementation of scenario 2 of FIG. 7B, is depicted in the bottom plan view of pallet deck 14 in FIG. 8A, and the top plan view of a runner 16 in FIG. 8B. In this embodiment, longitudinal channels 30' are molded into the lower surface 66 of the molded plastic pallet deck 14. Threaded openings 68 are also molded into the lower surface 66 of deck 14 on alternate sides of channel 30'. Runners 16 include bolt receiving retainer means 70 aligned with threaded openings 68. The bolt receiving retainer means 70 are located in legs 72 which extend vertically from runner base 74. Legs 72 define openings or recesses through which forklift tines may extend to contact the lower surface 66 of pallet platform 14.

Near the top of legs 70, a complementary channel or notch 76 is formed to receive and accommodate the exposed anti-skid surface of reinforcing bars 32 when such bars are placed in channels 30' of the lower surface 66 of deck 14. Bolting of runners 16 to threaded apertures 68 in the underside of deck 14 not only secures the runners in place but also traps and locks reinforcing bars 32 in channels 30' with their anti-skid surfaces exposed along the lower surface of pallet deck 14.

Figures 9A, 9B:
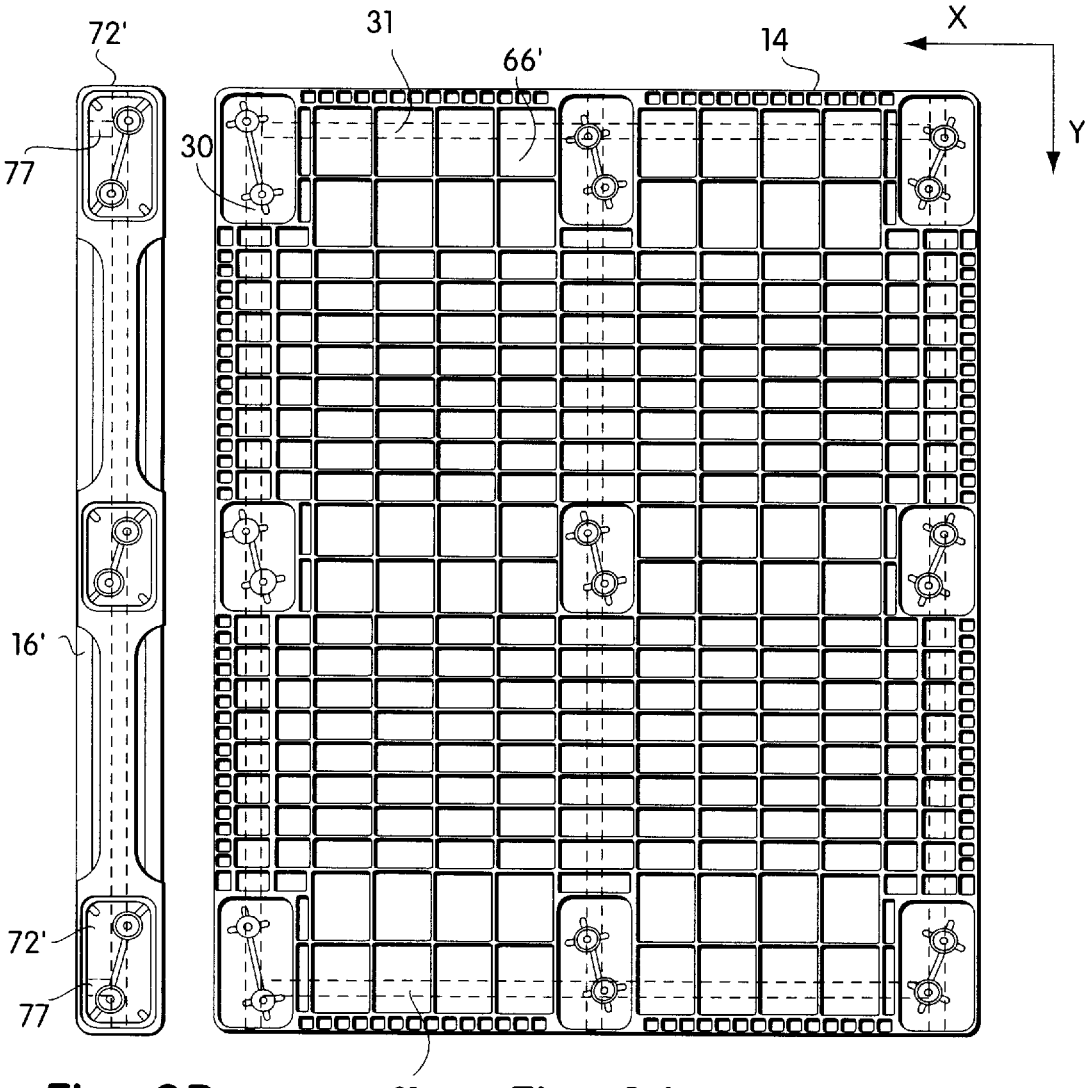
FIG. 9A is a view similar to FIG. 8A of the lower surface of a deck of a single deck pallet accommodating multiple orthogonal reinforcing bars.
FIG. 9B is a top plan view of a side runner for the pallet of FIG. 9A.

The pallet construction of FIGS. 9A and 9B is similar to that of FIGS. 8A and 8B, except that additional cross channels 31 and 77 are molded into the lower surface 66' of deck 14 and into the upper and lower legs 72' of side runner 16', respectively. Channels 31 and 77 accommodate additional, orthogonally positioned, reinforcing bars. The reinforcing bars of the present invention may extend in the X and/or Y directions, or possibly in other directions and/or configurations.

In the embodiments of FIGS. 8 and 9, the runner structures are discreet from the pallet deck. The runners may be secured to the underside of the deck using various known fastening techniques, e.g. mechanical fastening, heat sealing or ultrasonic welding. In all such embodiments, the reinforcing bars are preferably sandwiched between the top of the runner legs and the underside of the pallet deck. In an alternative approach, transverse holes can be selectively drilled through the sides of the reinforcing bars and then the plastic pallet molded in situ around the reinforcing bars so that the plastic flows through the holes to interlock and secure the reinforcing members in channels in the pallet body.

Figure 7C:
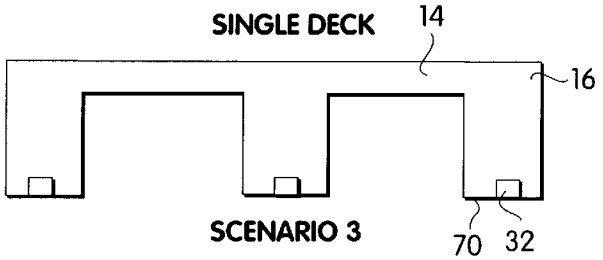
Figure 7D:
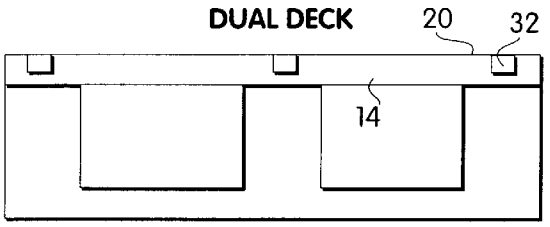
Figure 10:
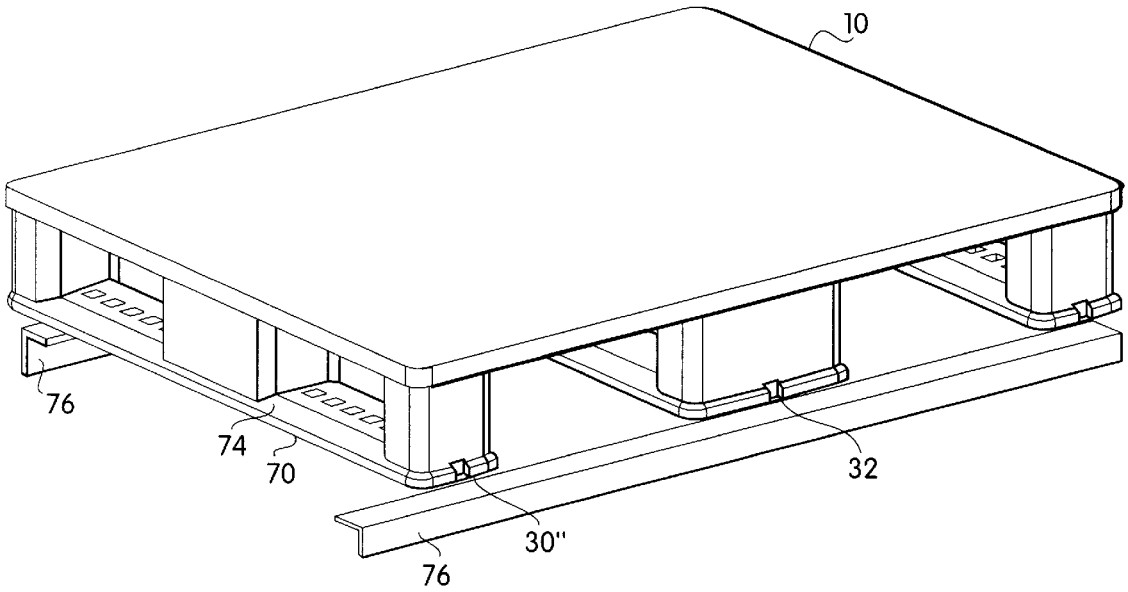
FIG. 10 is a perspective view of a rack supported single deck pallet constructed in accordance with the principles of the present invention.
Figure 11:
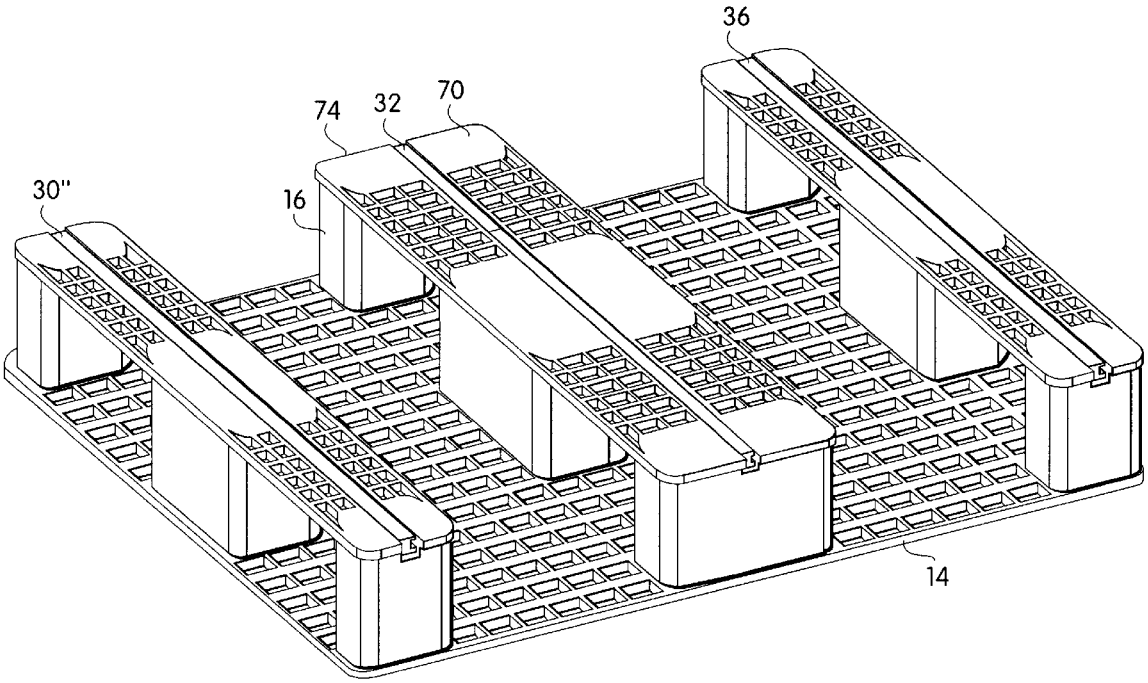
FIG. 11 is a bottom perspective view of the pallet of FIG. 10 showing the exposed reinforcing bars in the lower surface of the pallet runners.

Scenario 3 of FIG. 7C is depicted in FIGS. 10 and 11. In this embodiment, channels 30" are formed in the lower surface 70 of the base 74 of runners 16. Channels 30" receive reinforcing bars 32 having exposed anti-skid surface 36. Bars 32 may be retained within channels 30" by channel fins 64, like those shown in FIG. 6, or other suitable retaining means. Bars 32 not only limit movement of the pallet upon a floor surface but also advantageously provide additional support when the pallet 10 is mounted on racks in various warehousing applications, as shown in FIG. 10.

Figure 7E:
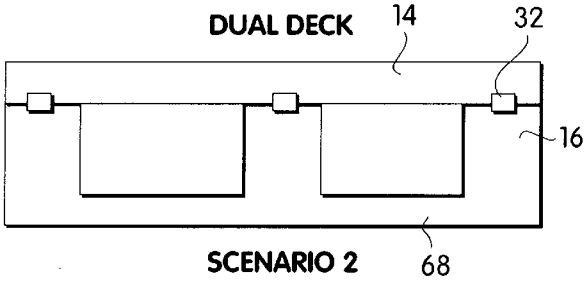
Figure 7F:
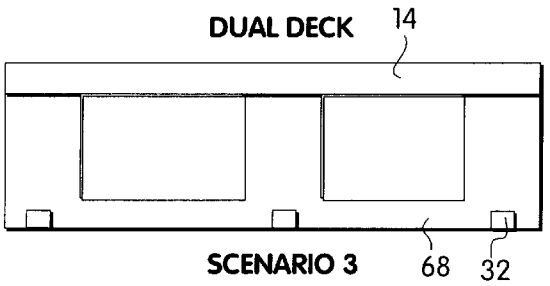
Figure 12:
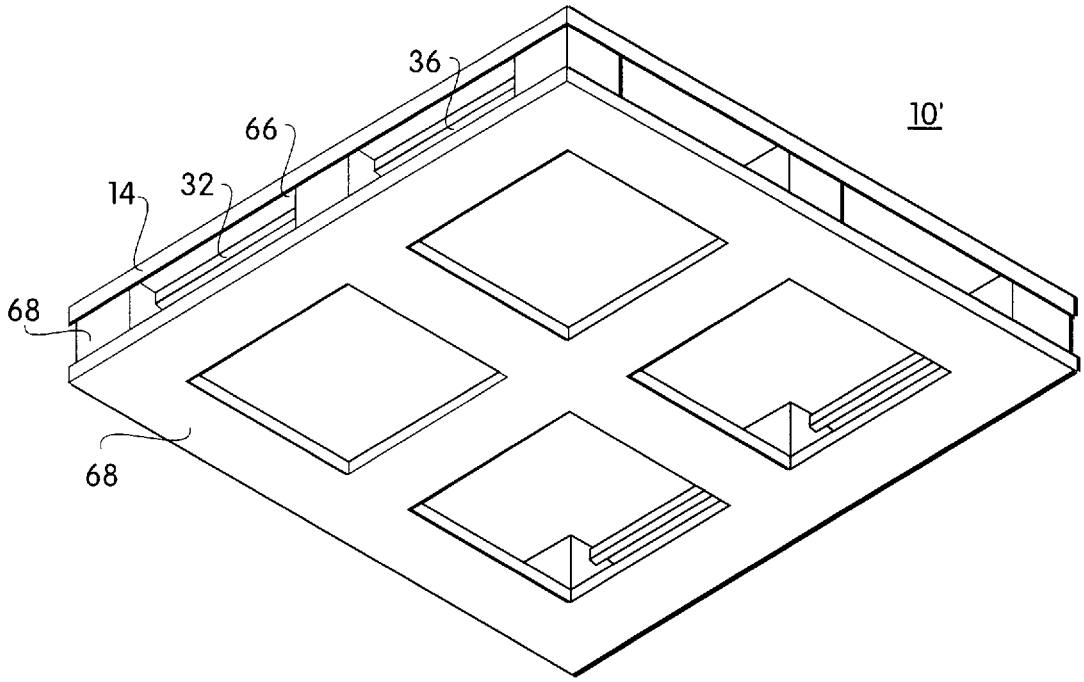
FIG. 12 is a bottom perspective view of a dual deck pallet with exposed reinforcing bars mounted to the lower surface of the top deck.

The scenario of FIG. 7E in which a reinforcing bar 32 having an exposed anti-skid surface 36 is mounted to the underside 66 of a top deck 14 in a dual deck pallet 10' is illustrated, in bottom perspective view, in FIG. 12. Bottom deck 68 is secured to the lower side 66 of top deck 14 using legs 72. Legs 72 also sandwich and serve to retain reinforcing bars 32 in their desired location on the underside of top deck 14. Bottom deck 68 and legs 72 may comprise a single unitary runner structure which is secured over a portion of each reinforcing bar 32 trapping the reinforcing bars between the top deck 14 and the runner structure.

Although various embodiments of the invention have been described and depicted herein, those skilled in this art will appreciate that various modifications, substitutions, additions and the like can be made without departing from the spirit of the invention. For example, although the invention has been described in the context of plastic pallets, the term "pallet" is intended to encompass dunnage, trays and other material handling and supporting structures. Such supporting structures which incorporate the unique reinforcing bars of the present invention may be produced in numerous different configurations, all of which are intended to be encompassed by the appended claims.

We claim:

1. A reinforced plastic pallet comprising:

a molded plastic pallet body having multiple channels formed therein; and multiple reinforcing bars comprising composite structural members of fiberglass reinforced plastic fabricated from a pultrusion process, each reinforcing bar being sized to reside within a different channel of said multiple channels formed in the molded plastic pallet body;

at least one of the multiple channels being configured such that when at least one of the multiple reinforcing bars is positioned therein, a surface of the reinforcing bar is exposed.

2. The reinforced plastic pallet of claim 1, wherein each reinforcing bar has a rectangular-shaped, I-shaped, H-shaped, U-shaped or T-shaped cross-sectional configuration.

3. The reinforced plastic pallet of claim 2, wherein the molded plastic pallet body having multiple channels formed therein comprises a top deck having multiple channels formed therein, and the reinforced plastic pallet further comprises multiple pallet runners secured to a lower surface of said top deck, said multiple pallet runners operating to at least partially retain said multiple reinforcing bars within said multiple channels in said top deck.

4. The reinforced plastic pallet of claim 1, wherein said molded plastic pallet body having multiple channels formed therein comprises a top deck having multiple channels formed therein, and said reinforced plastic pallet further comprises a bottom deck secured to a lower surface of said top deck, said bottom deck secured to said top deck operating to at least partially retain said multiple reinforcing bars within said multiple channels in said top deck.

5. The reinforced plastic pallet of claim 4, further comprising means for securing said bottom deck to said top deck proximate to said multiple reinforcing bars, said bottom deck comprising a single unitary support structure.

6. The reinforced plastic pallet of claim 1, wherein at least one reinforcing bar of said multiple reinforcing bars is retained within at least one of said multiple channels, said at least one reinforcing bar being positioned in said at least one channel in a manner such that a planar surface of the reinforcing bar is exposed, the exposed planar surface being substantially parallel with an upper surface or a lower surface of the molded plastic body.

7. A method for assembling a reinforced plastic pallet comprising:

providing a molded plastic pallet body having at least one channel formed in a surface thereof;

placing at least one reinforcing bar within the at least one channel formed in the molded plastic pallet body, said at least one reinforcing bar being sized and positioned in said at least one channel in a manner such that a surface of the reinforcing bar is exposed at said surface of said molded plastic pallet body; and applying a retainer to secure said at least one reinforcing bar within said at least one channel.

8. The method of claim 7, wherein said molded plastic pallet body of said providing step comprises a top deck, and said applying a retainer comprises securing a bottom deck to said top deck to retain said at least one reinforcing bar within said at least one channel, said at least one channel being formed in a lower surface of said top deck.

9. The method of claim 8, wherein said securing of said bottom deck to said top deck is accomplished by bolting or welding said bottom deck to said top deck, at least some bolts or welds being adjacent to said at least one reinforcing bar to ensure retainment of said at least one reinforcing bar between said top deck and said bottom deck.

10. The method of claim 7, wherein said providing step comprises providing a molded plastic pallet body having at least one opening in a side surface thereof for inserting/removing of said at least one reinforcing bar, and said applying a retainer comprises providing a side positioning member disposed partially over said surface of said molded plastic pallet body, said side positioning member having a retainer depending partially over said side surface of said molded plastic body having said opening therein, said retainer having an opening corresponding to the opening in said side surface of said molded plastic pallet body and aligning therewith, and said method further comprises securing a snap clip within the aligned openings of the retainer and the side surface to secure the at least one reinforcing bar within the at least one channel of the molded plastic pallet body.

11. A reinforced plastic pallet comprising:

a molded plastic pallet body having multiple channels formed therein; and multiple reinforcing bars comprising composite structural members of fiberglass reinforced plastic fabricated from a pultrusion process, each reinforcing bar being sized to reside within a different channel of said multiple channels formed in the molded plastic pallet body;

wherein at least one reinforcing bar of said multiple reinforcing bars is retained within at least one of said multiple channels, said at least one reinforcing bar being positioned in said at least one channel in a manner such that a planar surface of the reinforcing bar is exposed, the exposed planar surface being substantially parallel with an upper surface or a lower surface of the molded plastic body.

* * * * *